US006837019B2

(12) United States Patent
Collie

(10) Patent No.: US 6,837,019 B2
(45) Date of Patent: Jan. 4, 2005

(54) TORNADO AND HURRICANE ROOF TIE

(76) Inventor: Anthony D Collie, P.O. Box AP-59226, Kennedy Subdivision, New Providence (BS)

( * ) Notice: Subject to any disclaimer, the term of this patent is extended or adjusted under 35 U.S.C. 154(b) by 81 days.

(21) Appl. No.: 10/211,138

(22) Filed: Aug. 2, 2002

(65) Prior Publication Data

US 2003/0200705 A1 Oct. 30, 2003

(51) Int. Cl.[7] ..... E04B 1/38; E04C 5/00

(52) U.S. Cl. ..... 52/712; 52/489.1; 52/655.1; 52/702; 52/92.2; 52/92.1; 52/715

(58) Field of Search ..... 52/127.1, 489.1, 52/633, 647, 646, 653.1, 92.2, 93.2, 289, 702, 712, 745.12, 745.21, 741.1, 92.1, 714, 715, 655.1; 403/232.1, 364

(56) References Cited

U.S. PATENT DOCUMENTS 4,714,372 A 12/1987 Commins
4,932,173 A 6/1990 Commins
5,230,198 A 7/1993 Callies
5,857,295 A 1/1999 Mikawa
6,658,806 B1 * 12/2003 Leek ..... 52/295

* cited by examiner

*Primary Examiner*—Carl D. Friedman
*Assistant Examiner*—Chi Q Nguyen
(74) *Attorney, Agent, or Firm*—Whiteford, Taylor & Preston LLP; Jeffrey C. Maynard; Gregory M. Stone

(57) ABSTRACT

A building roof tie for attaching roof trusses and rafters to wood top plates in building structures, such roof tie having a sheet metal body with risers and a bridge for overlapping a rafter and flaps for wrapping on the sides of the top plate. Generally triangular shaped reinforcing wings provide strength and stability, allowing the roof tie to be manufactured from different weights of steel. The roof ties are pitched to conform to a variety of framing applications. A plurality of apertures is formed in the roof tie to provide openings for fasteners for connecting the tie to the wood top plate and rafter.

20 Claims, 15 Drawing Sheets

TORNADO AND HURRICANE ROOF TIE

BACKGROUND OF THE INVENTION

Field of the Invention

This invention relates generally to building structures with wood roofs, and more particularly to structures exposed to extreme wind conditions, such as Tornadoes and Hurricanes, where building codes dictate that such structures be protected against structural failure to save lives of occupants. In particular, the present invention relates to a roof tie for anchoring a wood frame roof on a block construction building in order to resist uplift forces encountered during a high wind situation.

BACKGROUND OF THE PRIOR ART

It is well known what high winds can do to a building, particularly to a wood frame construction low-rise structure. Generally, uplift forces tending to lift the roof off the structure or the entire structure off its foundation cause much of the damage sustained by the building.

Wood structures predominate in residential and light commercial construction, and when wood framing is employed the structure must be protected from upward loads developed by high wind, which differs with geographical location and is enforced by different building codes for such areas. For example, the Bahamas and Florida, including the Florida Keys are situated in the pathway of the yearly Caribbean hurricane travel course and as such, encounter hurricanes and/or tornadoes from time to time. Houses in the Bahamas are typically constructed of cement block with a wooden top plate fastened to the top of cement block walls, for attaching a wooden roof. In the case of upward loads, the roof is generally tied to the walls using a variety of steel connectors that tie the top plate to the walls. The size and number of these steel connectors vary depending on the severity of the wind conditions in the locality of the building, and the building's geometry. Due to the house location in a susceptible high wind area, some building codes require that houses built with wooden roof support beams have a "Hurricane Tie" in place on every rafter.

"Hurricane Ties" are usually installed during the foundation and framing stages of construction. Laborers hired by the framing contractor generally install connectors and sheathing. Correct size, location and number of fasteners (nails or bolts) are critical to sustaining the required load. Commonly, such laborers are inexperienced which results in improper or inadequate installation. In all structures, locations of connectors mandate their installation during the framing stage due to related components being placed at the same time. This process slows the foundation and framing stages of construction, which in turn increases labor costs.

From the foregoing, it is apparent that there is a critical need for a strong roof tie system that provides for uplift loads which is cost effective and easy to install.

SUMMARY OF THE INVENTION

The present invention provides a solution to the above and other problems by reinforcing and anchoring the roof structure to the building top plate, wherein a hold down force is applied to the ceiling rafters to counter the uplift and horizontal forces generated by high winds. The present invention can be incorporated during initial construction of a wooden roof structure.

It is an object of the present invention to provide a bracket system for a wooden roof structure of a building that reinforces the roof against damage in a high wind situation, such as a hurricane.

It is another object of the present invention to provide a roof-tie bracket system for a wooden roof construction building that provides a downward force around the periphery of the roof, thereby to better resist any upward lift imparted to the roof by high winds.

It is another object of the present invention to provide a roof-tie bracket system for a wood frame roof that provides reinforcement to the roof structure, thereby providing greater resistance to damage during high wind conditions. A related object is to increase public safety in structures existing in high wind areas.

It is yet another object of the present invention to enable cost effective construction of wooden roof structures while meeting all building code requirements. A related object is to provide a roof-tie bracket system for a low-rise building that complies with the recommendation of all major building codes.

This invention relates to a novel roof-tie bracket system for bracing a wood framed roof of a building, e.g., a residential dwelling, having a structure including a foundation upon which rests a wall construction and horizontal ceiling plates. The structure is reinforced against the destructive forces of the atmosphere by high strength brackets preferably attached to every rafter where it joins the ceiling plates. The roof-tie bracket is connected to the structure by way of a plurality of fasteners, such as nails or lag bolts.

The roof-tie bracket disclosed herein offers more body, more nailing surfaces, more wrapping capability, more strength and more durability to the purchasing public. Such roof-tie brackets may be made from a graduated increase in sheet metal gauges in a variety of straps or ties to fit many framing applications and strength requirements. Moreover, such roof-tie brackets may be pre-pitched to a predetermined angle of a roof, keeping in mind the different sizes of wood that may be used to pitch a roof. Such roof-tie brackets create a solid attachment between a rafter and ceiling top plate. This simple invention enables a family of roof-tie brackets that can be mass-produced and sold for a reasonable price that, in fact, can be made or put in place by any skilled or semi-skilled person.

Some of the advantages of this invention include: increase in surface area of a roof-tie bracket, thereby creating more surfaces through which nails could penetrate the substructure; "prepitched" roof-tie brackets that create a snug fit over all substructures and angles, at angles consistent with industry roof pitch standards; a "decking window" that allows fastening of nails through the "deck" to the rafter beneath; "plate flaps" that further secures the roof-tie bracket to the top plate; and, in some embodiments, a "ceiling joist and cradle" that provides further for the "strapping" of ceiling joists, all in one simple Hurricane and Tornado Tie.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF THE INVENTION

The invention summarized above and defined by the enumerated claims may be better understood by referring to the following description, which should be read in conjunction with the accompanying drawings in which like reference numbers are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments: disclosed as a basis for modifying or designing other methods and systems for carrying out the same purposes of the present invention. Those skilled in the art should also realize that such equivalent assemblies do not depart from the spirit and scope of the invention in its broadest form.

Figure 1A:
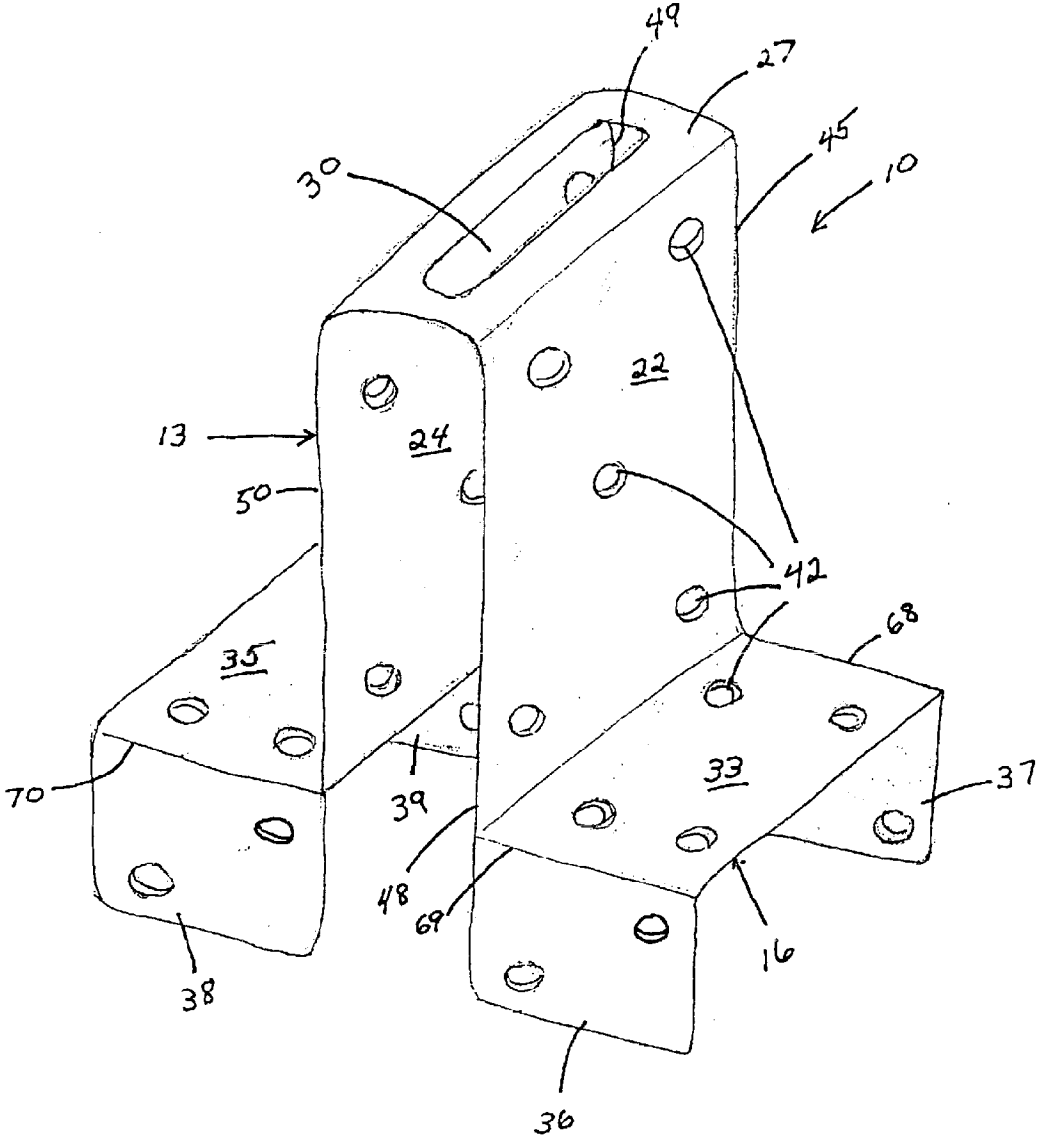
FIG. 1*a* shows an illustration of a roof tie in perspective according to one embodiment of the present invention.

Referring to FIG. 1*a*, a roof tie according to the present invention, indicated generally as 10, is illustrated, having an upper portion 13 and a lower portion 16. Such upper portion 13 comprises two risers 22, 24, substantially parallel to each other and a bridge 27 connecting the top of risers 22, 24. Bridge 27 provides separation between risers 22, 24 and presents a large window area 30. The amount of separation between risers 22, 24 should conform to the standard thickness of construction materials, such as wooden 2×4s. The lower portion 16 of such roof tie 10 comprises fastener extensions 33, 35, which extend at right angles from risers 22, 24, respectively and each of which fastener extensions 33, 35 further comprise top plate flaps 36, 37, 38, 39. Top plate flaps 36, 37, 38, 39 extend at right angles down from fastener extensions 33, 35, and are designed to wrap on the sides of a ceiling top plate. A plurality of apertures 42 for inserting fasteners, such as nails, are disposed on such risers 22, 24, fastener extensions 33, 35, and top plate flaps 36, 37, 38, 39. Such plurality of apertures should be disposed in a staggered fashion to prevent splitting of the top plate and rafter when inserting such fasteners.

In some embodiments, the length of the forward edge 45 of riser 22 may be longer than the rear edge 48 of such riser 22, correspondingly, the forward edge 49 of riser 24 may be longer than the rear edge 50 of such riser 24 in order to have bridge 27 angled to correspond to a selected pitch for a roof.

Figure 1B:
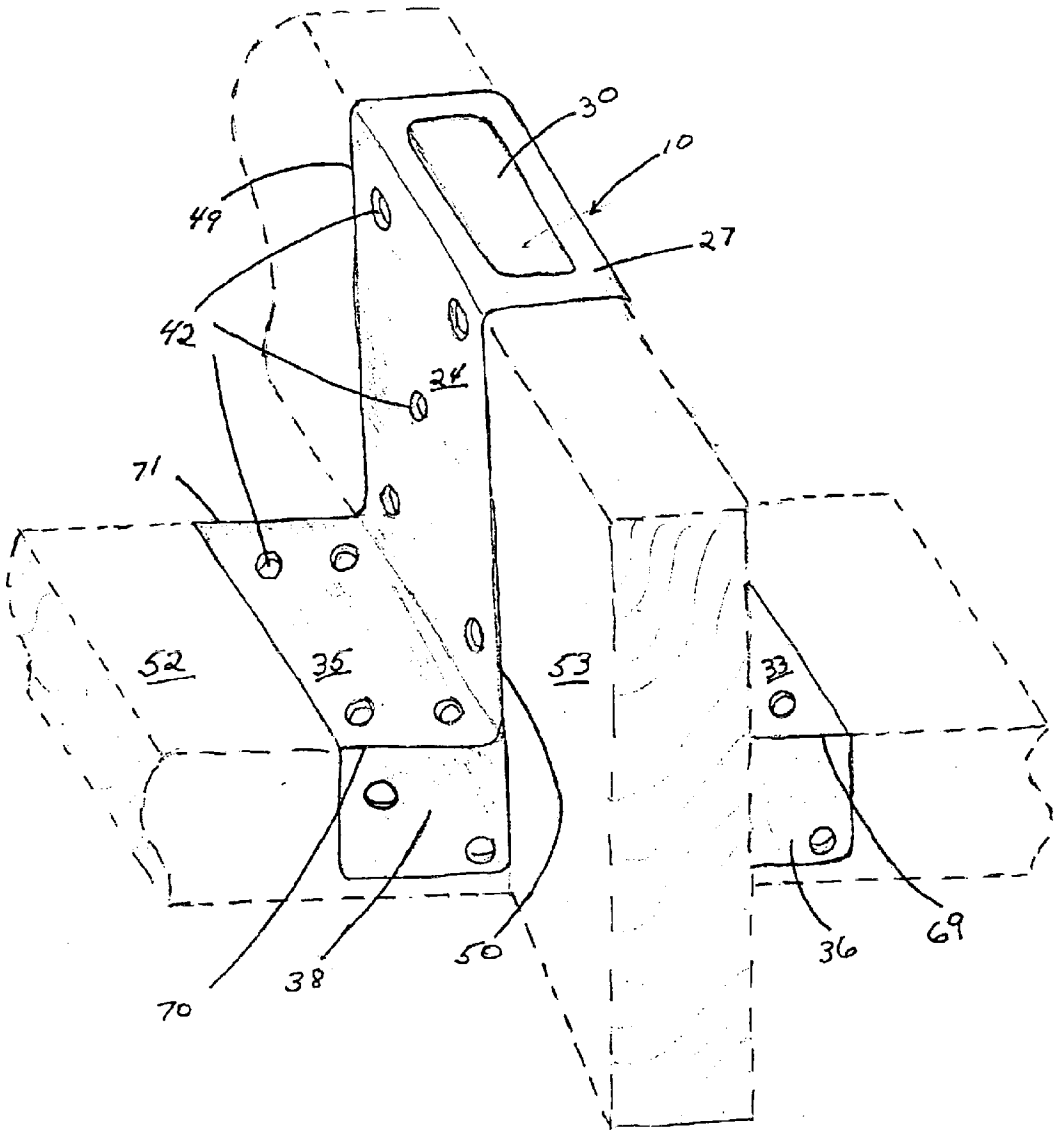
FIG. 1*b* shows an illustration of a roof tie, with a top plate and rafter in phantom, according to one embodiment of the present invention.

An application showing use of such roof tie 10 is illustrated in FIG. 1*b* presenting roof tie 10 in a position for fastening to top plate 52 and rafter 53. Fasteners are attached to top plate 52 and rafter 53 through apertures 42. Using a fastener in each opening ensures a strong and secure attachment. Additional embodiments using various numbers of holes can be used based on specific engineering requirements as determined by one skilled in the art. As shown in FIG. 1*b*, top plate flaps 36, 37, 38, 39 are fastened to the sides of top plate 52, providing a wrap around most of such top plate 52. Window area 30 is provided to enable fastening of decking material to rafter 53.

Figure 2:
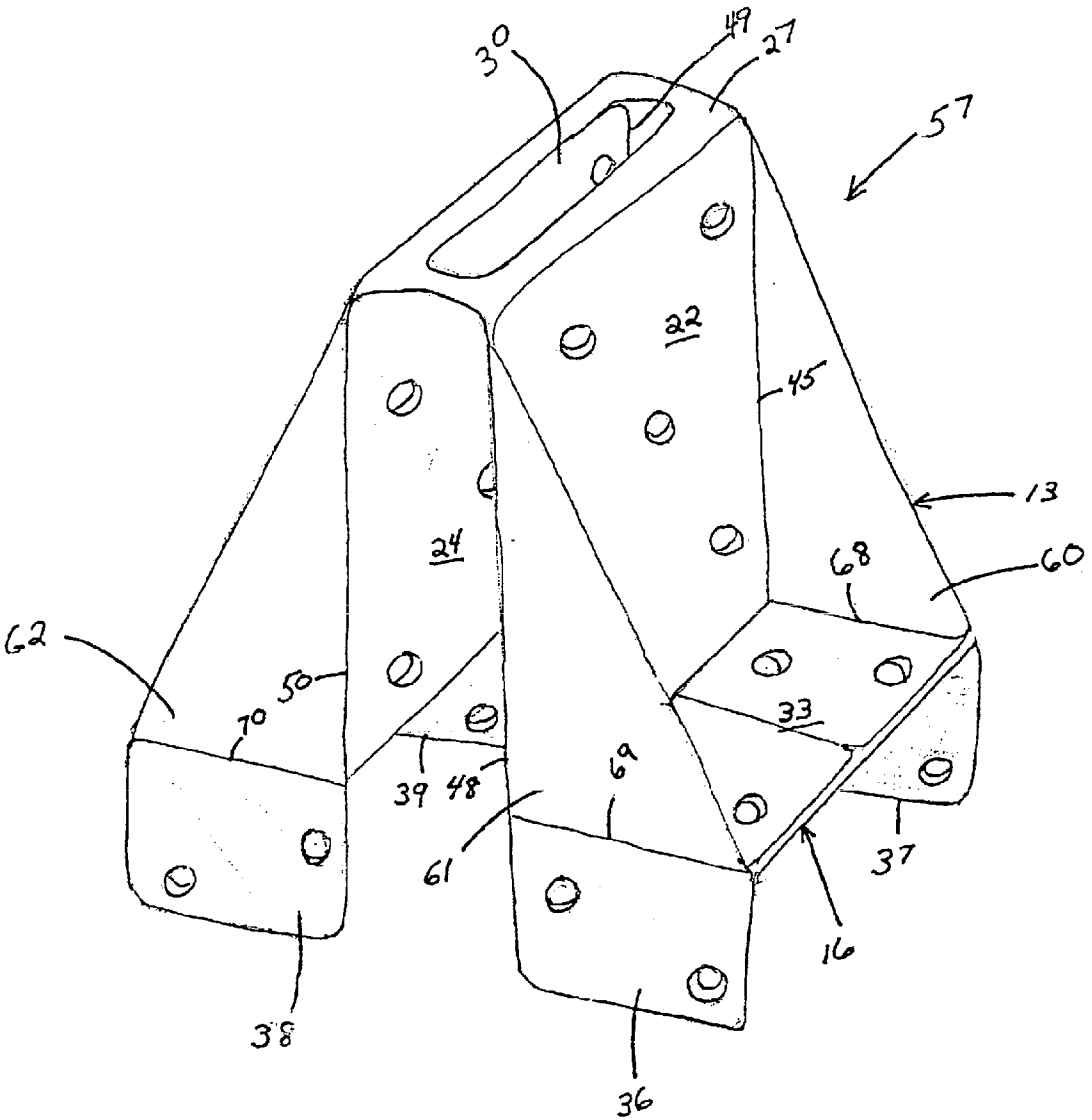
FIG. 2 shows an illustration of a roof tie in perspective according to an alternate embodiment of the present invention.

FIG. 2 illustrates an alternate embodiment of a roof tie, indicated generally as 57, according to the present invention. For heavy-duty applications, roof tie 57 further comprises reinforcing wings 60, 61, 62, 63 (not shown). Such reinforcing wings 60, 61, 62, 63 (not shown) are generally triangular in shape. For example, reinforcing wing 60 extends from the forward edge 45 of riser 22 to the end of forward edge 68 of fastener extension 33 and reinforcing wing 61 extends from the rear edge 48 of riser 22 to the end of rear edge 69 of fastener extension 33. Similarly, reinforcing wing 62 extends from the rear edge 50 of riser 24 to the end of rear edge 70 of fastener extension 35 and reinforcing wing 63 (not shown) extends from the forward edge 49 of riser 24 to the end of forward edge 71 of fastener extension 35. Such reinforced heavy duty roof tie 57 provides vertical reinforcement to prevent balking while enabling increased rigidity to roof tie 57, resulting in a sturdier, stronger roof tie 57. Such increased strength can be obtained at reduced cost by enabling use of lower galvanized steel gauges for its construction. Balking is caused by misalignment of trusses due to warping of roof timbers or loosening of fastened joints, resulting in roof decking being heaved up along such misaligned roof truss.

Figure 3C:
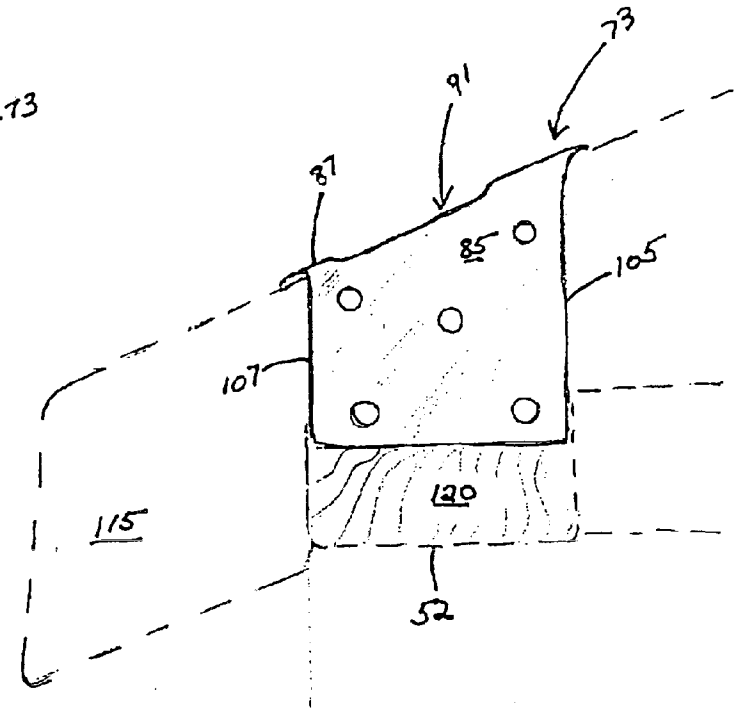
FIG. 3*c* is rear elevation view of a gable-end roof tie, with top plate and gable in phantom, according to another embodiment of the present invention.
Figure 3A:
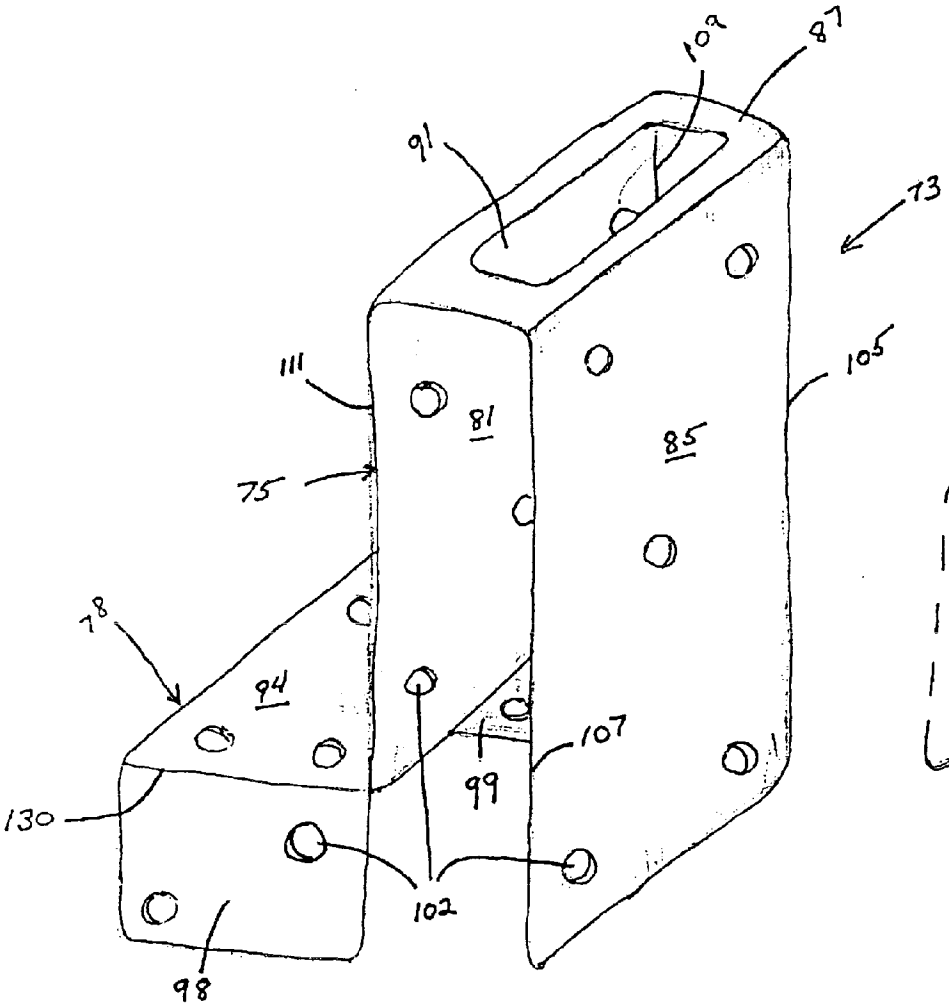
FIG. 3*a* shows an illustration of a gable-end roof tie in perspective according to one embodiment of the present invention.

Referring to FIG. 3*a*, a gable-end roof tie according to the present invention, indicated generally as 73, is illustrated, having an upper portion 75 and a lower portion 78. Such upper portion comprises riser 81, substantially parallel to back 85 and a bridge 87 connecting the top of riser 81 to the top of back 85. Bridge 87 provides separation between riser 81 and back 85 and presents a large window area 91. The amount of separation between riser 81 and back 85 should conform to the standard thickness of construction materials, such as wooden 2×4s. The lower portion 78 of such gable-end roof tie 73 comprises a fastener extension 94, which extends at a right angle from riser 81, further comprising top plate flaps 98, 99. Top plate flaps 98, 99 extend at right angles down from fastener extension 94, and are designed to wrap on the sides of a ceiling top plate. A plurality of apertures 102 for inserting fasteners, such as nails, are disposed on such riser 81, back 85, fastener extension 94, and top plate flaps 98, 99 (shown more particularly in FIG. 3*b*). Such plurality of apertures should be disposed in a:

staggered fashion to prevent splitting of the top plate and gable when inserting such fasteners.

In some embodiments, the length of the forward edge 105 of back 85 may be longer than the rear edge 107 of such back 85, correspondingly, the forward edge 109 of riser 81 may be longer than the rear edge 111 of such riser 81 in order to have bridge 87 angled to correspond to a selected pitch for a roof, as illustrated in FIG. 3*c*.

Figure 3B:
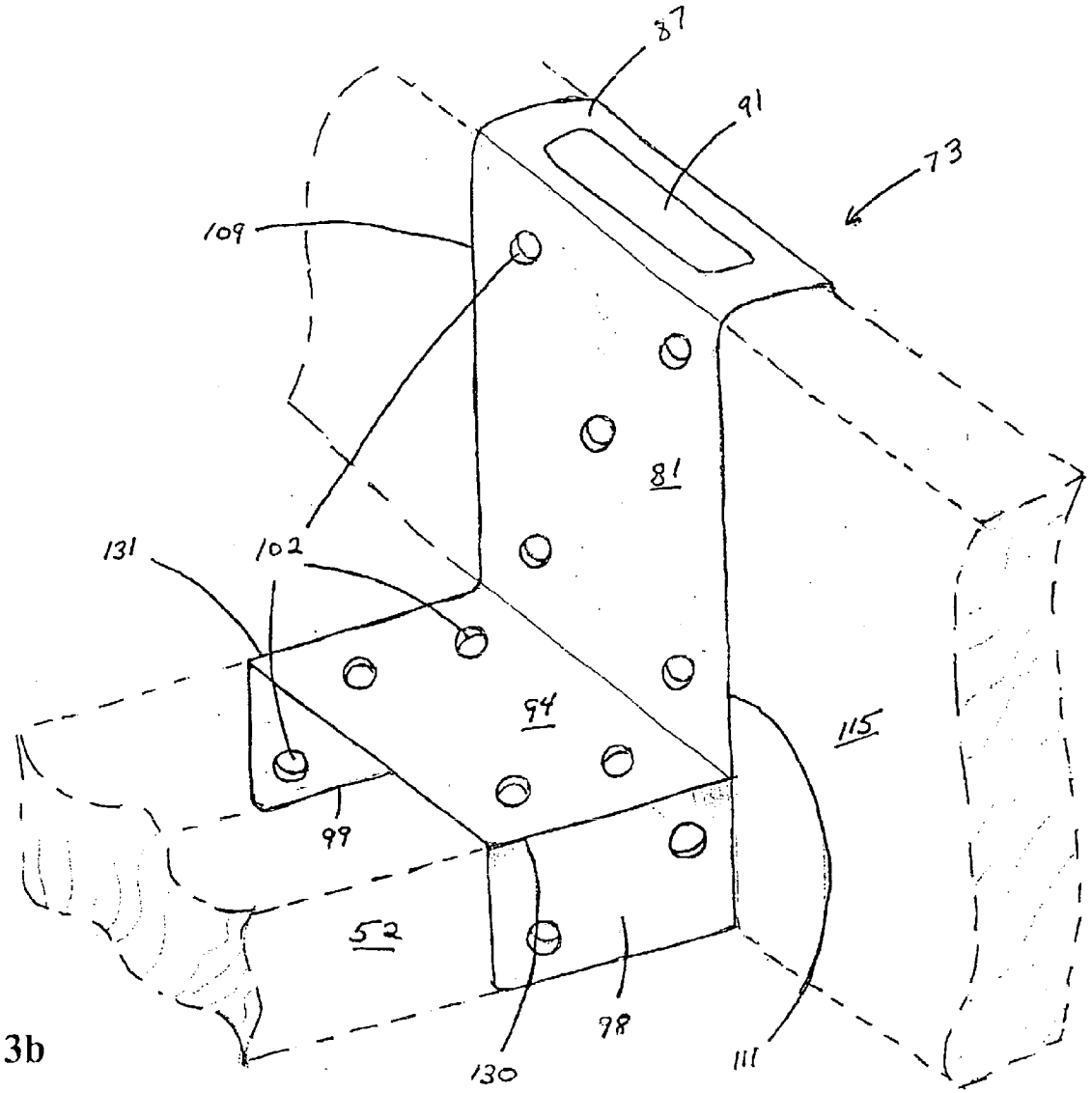
FIG. 3*b* shows an illustration of the gable-end roof tie of FIG. 3*a*, with top plate and gable in phantom, according to one embodiment of the present invention.

An application showing use of such gable-end roof tie 73 is illustrated in FIG. 3*b* presenting gable-end roof tie 73 in a position for fastening to top plate 52 and gable 115. Fasteners are attached to top plate 52 and gable 115 through apertures 102. Using a fastener in each opening ensures a strong and secure attachment. Additional embodiments using various numbers of holes can be used based on specific engineering requirements as determined by one skilled in the art. As shown in FIG. 3*b*, top plate flaps 98, 99 are fastened to the sides of top plate 52, providing a wrap around most of such top plate 52. Window area 91 is provided to enable fastening of decking material to gable 115.

FIG. 3*c* is a rear elevation view of gable-end roof tie 73. The length of the forward edge 105 of back 85 is shown as longer than the rear edge 107 of such back 85 in order to have bridge 87 angled to correspond to a selected pitch for a roof. The length of such forward edge 105 and rear edge 107 should be long enough, such that back 85 extends, at least partially, over the butt end 120 of top plate 52.

Figure 4A:
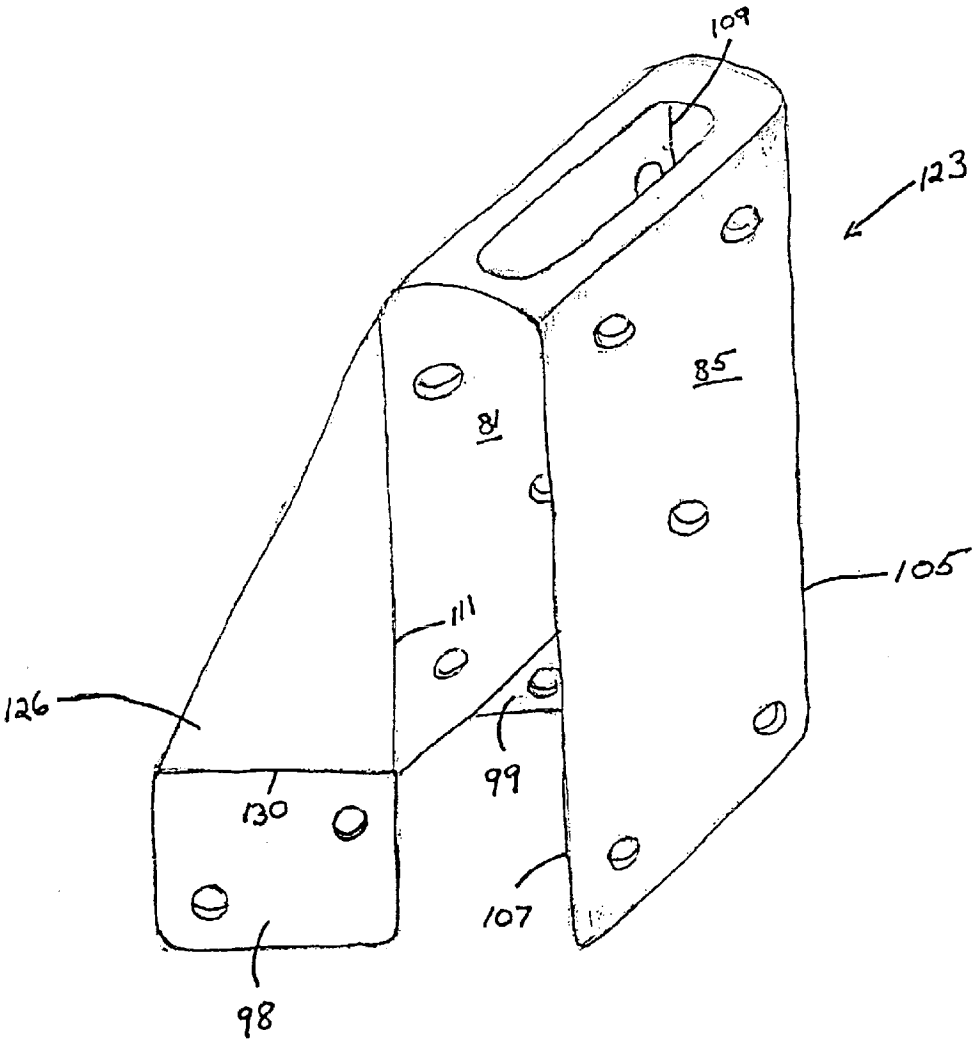
FIGS. 4*a* and 4*b* show an illustration of a gable-end roof tie in perspective according to an alternate embodiment of the present invention.
Figure 4B:
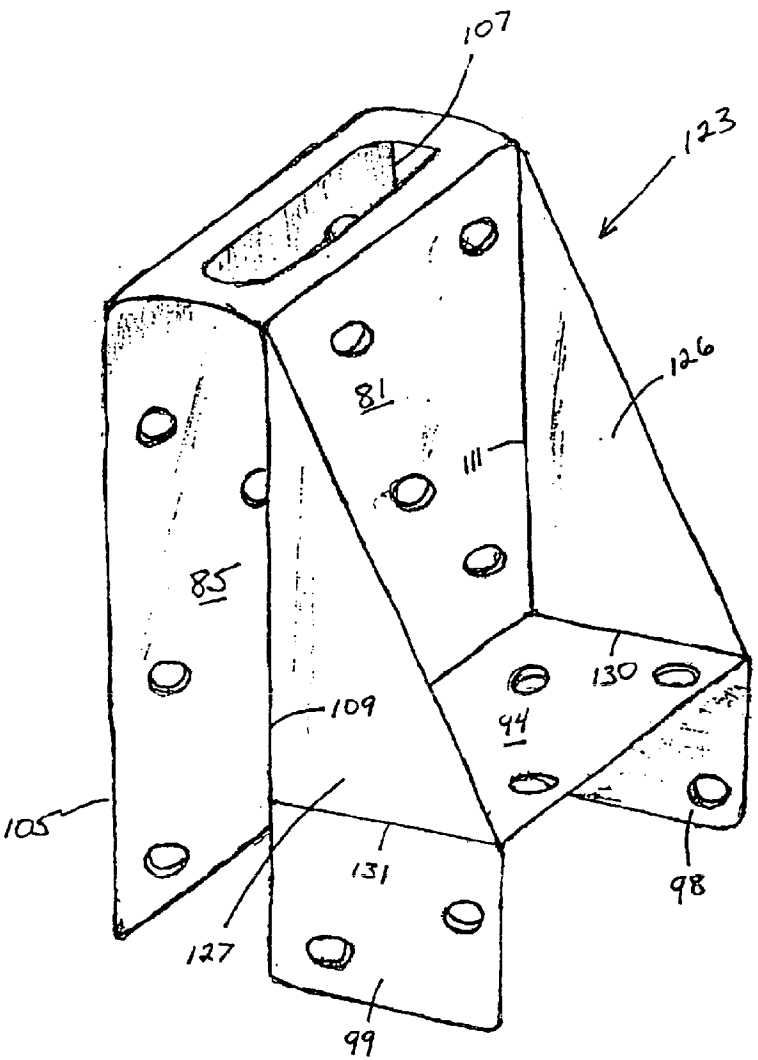

FIGS. 4*a* and 4*b* illustrate an alternate embodiment of a gable-end roof tie, indicated generally as 123, according to the present invention. For heavy-duty applications, gable-end roof tie 123 further comprises reinforcing wings 126, 127. Such reinforcing wings 126, 127 are generally triangular in shape. For example, reinforcing wing 126 extends from the rear edge 111 of riser 81 to the end of rear edge 130 of fastener extension 94 and reinforcing wing 127 extends from the forward edge 109 of riser 81 to the end of forward edge 131 of fastener extension 94. Such reinforced heavy duty gable-end roof tie 123 provides vertical reinforcement to prevent balking while enabling increased rigidity to gable-end roof tie 123, resulting in a sturdier, stronger tie. Such increased strength can be obtained at reduced cost by enabling use of lower galvanized steel gauges for its construction.

Figure 5:
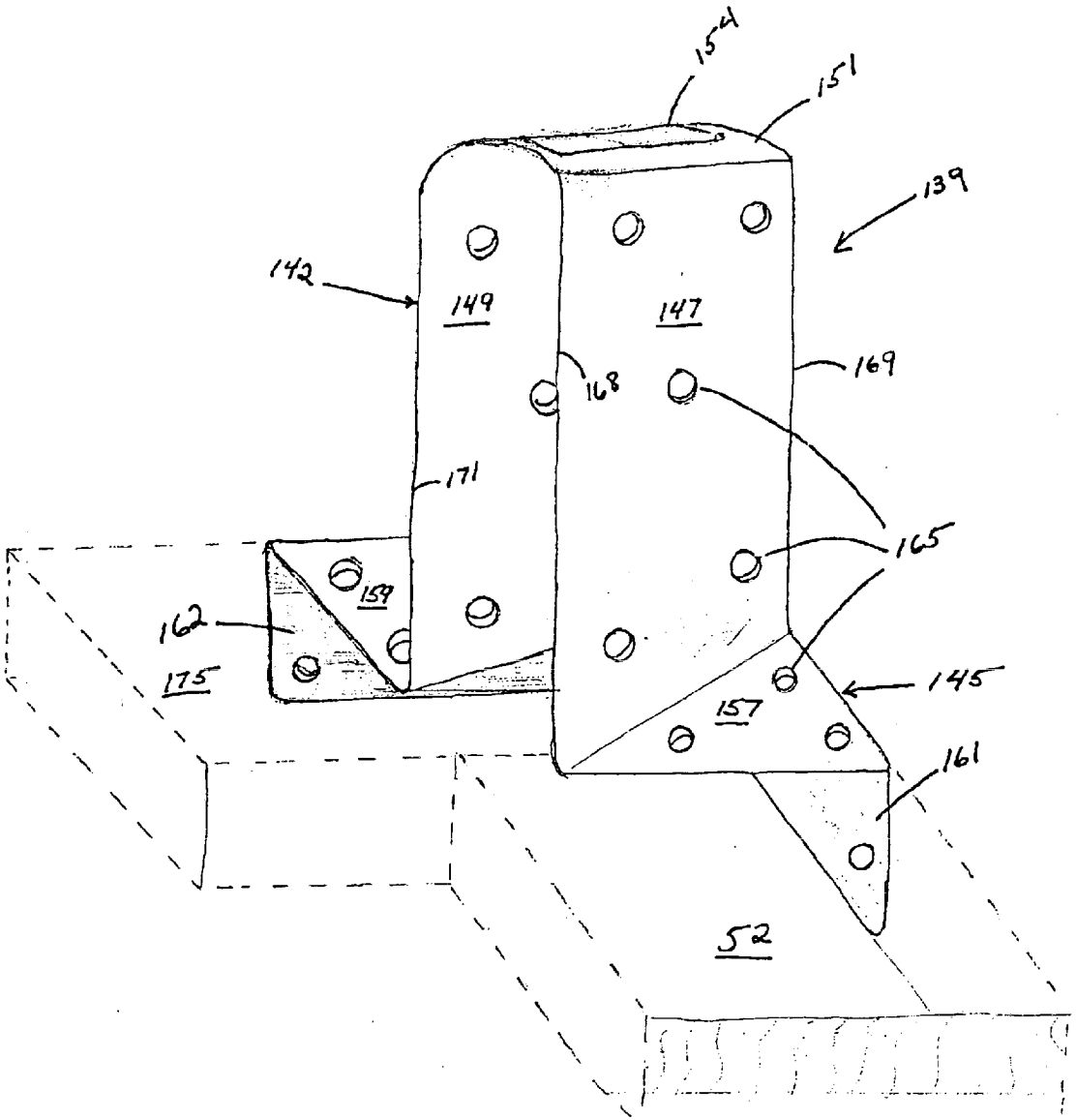
FIG. 5 shows an illustration of a hip-rafter roof tie in perspective according to one embodiment of the present invention.

Referring to FIG. 5, a hip-rafter roof tie according to the present invention, indicated generally as 139, is illustrated, having an upper portion 142 and a lower portion 145. Such upper portion 142 comprises two risers 147, 149, substantially parallel to each other and a bridge 151 presenting a large window area 154 connecting the top of risers 147, 149. Bridge 151 provides separation between risers 147, 149. Such separation should conform to the standard thickness of construction materials, such as wooden 2×4s. The lower portion 145 of such hip-rafter roof tie 139 comprises fastener extensions 157, 159, which extend at right angles from risers 147, 149, respectively, each of which fastener extensions 157, 159 further comprise top plate flaps 161, 162. A plurality of apertures 165 for inserting fasteners, such as nails are disposed on such risers 147, 149, fastener extensions 157, 159, and top plate flaps 161, 162. Such plurality of apertures should be disposed in a staggered fashion to prevent splitting of the top plates and rafter when inserting such fasteners.

In some embodiments, the length of the forward edge 168 of riser 147 may be longer than the rear edge 169 of such riser 147, correspondingly, the forward edge 171 of riser 149 may be longer than the rear edge 172 (not shown) of such riser 149 in order to have bridge 151 angled to correspond to a selected pitch for a roof.

Top plate flaps 161, 162 extend at right angles down from fastener extensions 157, 159, and are arrayed to be substantially perpendicular to each other for attachment to top plates 52, 175, which are illustrated as intersecting at a right angle, such as at a corner of a building. For applications in which top plates 52, 175 intersect at an angle other than a right angle, top plate flaps 161, 162 should be arrayed at an angle corresponding to the angle of intersection of top plates 52, 175. Fasteners are attached to top plates 52, 175 through apertures 165. Using a fastener in each opening ensures a strong and secure attachment. Additional embodiments using various numbers of holes can be used based on specific engineering requirements as determined by one skilled in the art.

Figure 6A:
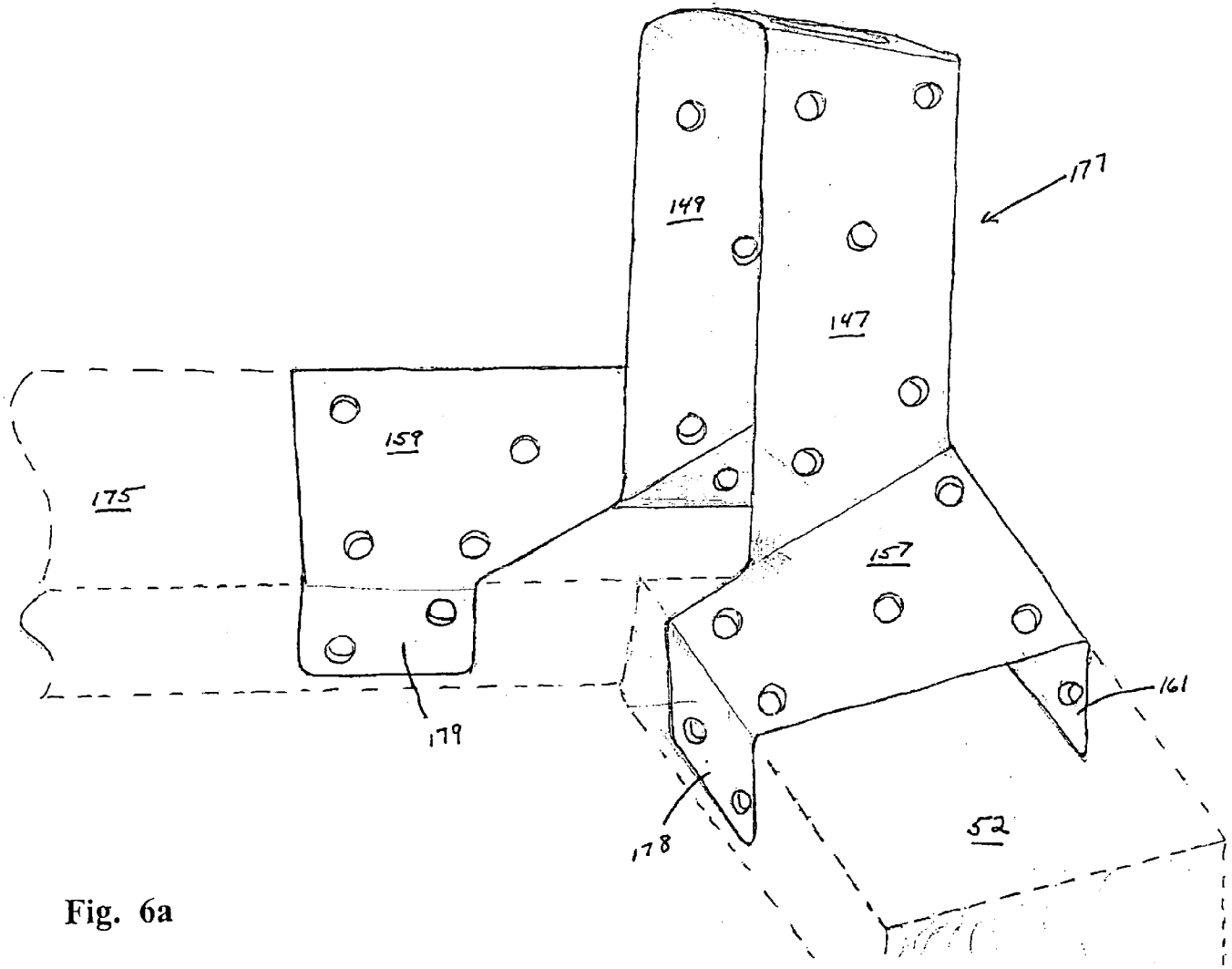
FIGS. 6*a* and 6*b* show an illustration of a hip-rafter roof tie in perspective according to an alternate embodiment of the present invention.
Figure 6B:
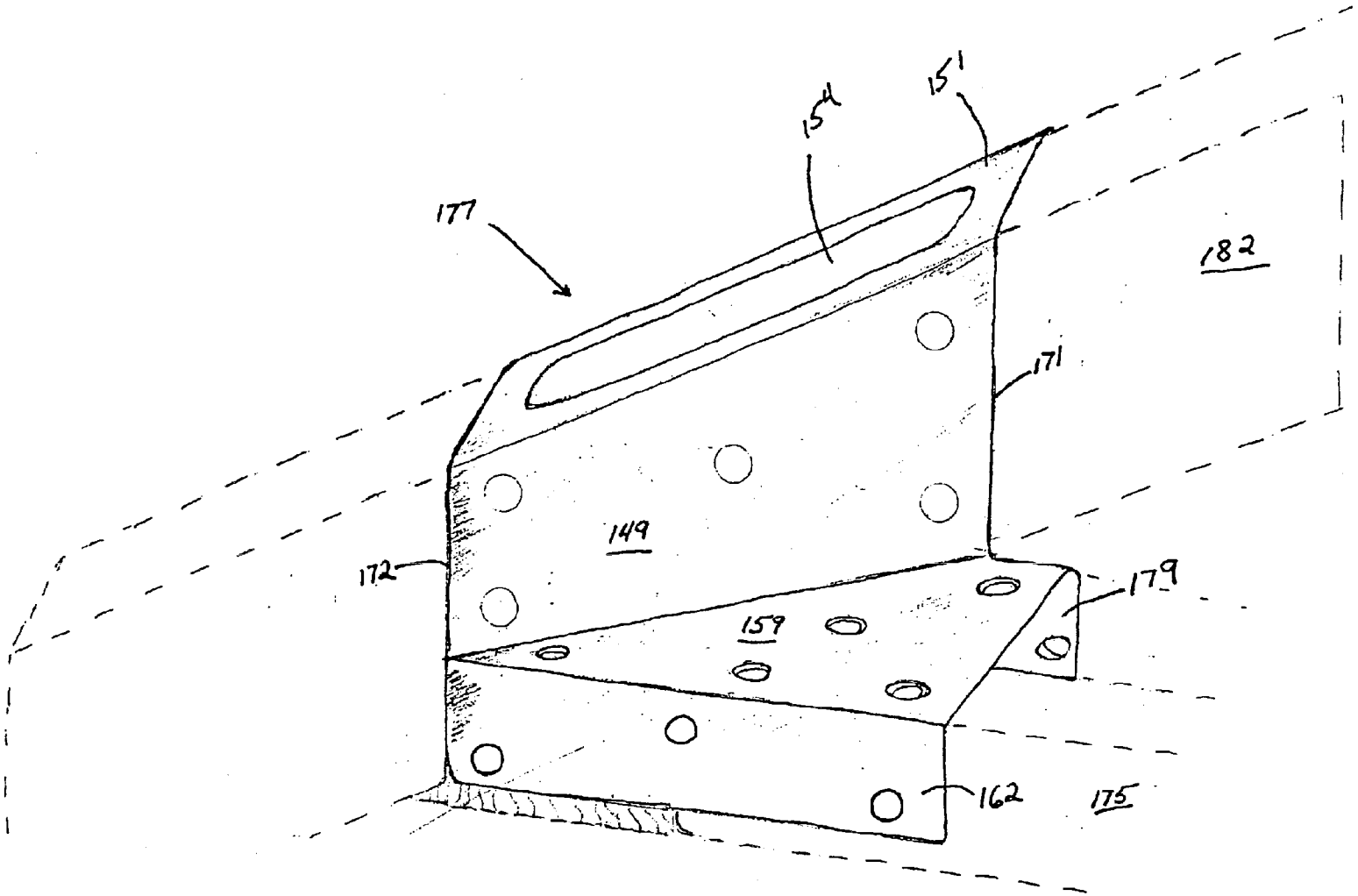

FIGS. 6*a* and 6*b* illustrate an alternate embodiment of a hip-rafter roof tie, indicated generally as 177, according to the present invention. For heavy-duty applications, hip-rafter roof tie 177 further comprises top plate flaps 178, 179, substantially parallel to top plate flaps 161, 162, respectively. To accommodate such top plate flaps 178, 179, fastener extensions 157, 159 are slightly larger. As shown in FIGS. 6*a* and 6*b*, top plate flaps 161, 162, 178, 179 are fastened to the sides of top plates 52 and 175, providing a wrap around most of such top plates for reinforcement of such hip-rafter roof tie 177.

As can be seen in FIG. 6*b*, the length of the forward edge 171 of riser 149 is shown as longer than the rear edge 172 of such riser 149 in order to have bridge 151 angled to correspond to a selected pitch for rafter 182. Window area 154 is provided to enable fastening of decking material to rafter 182.

Figure 7:
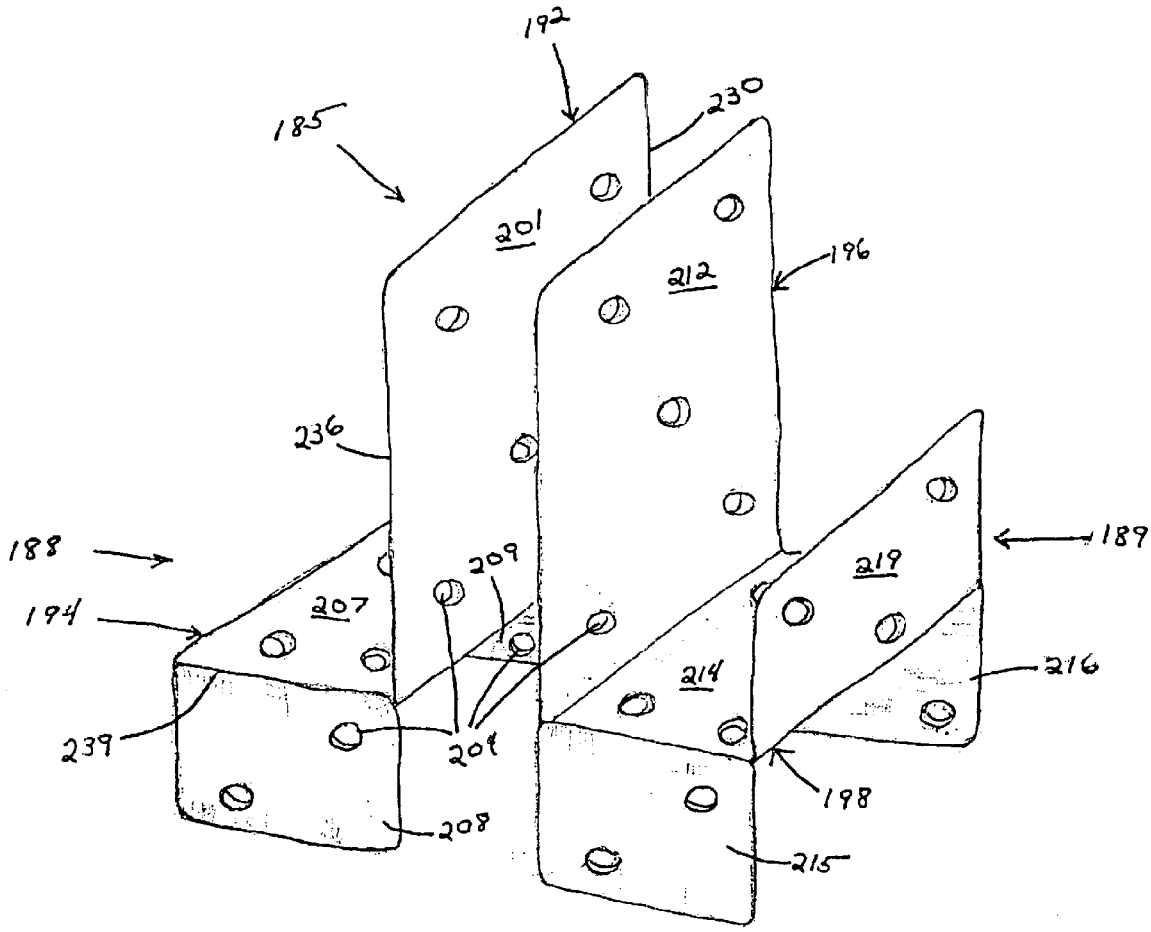
FIG. 7 shows an illustration of a joist cradle tie in perspective according to one embodiment of the present invention.

FIG. 7 shows a joist cradle tie according to the present invention, indicated generally as 185, comprising a tie component 188 and a cradle component 189, such tie component 188 having an upper portion 192 and a lower portion 194 and such cradle component 189 having an upper portion 196 and a lower portion 198. Such upper portion 192 of such tie component 188 comprises a riser 201 having a plurality of apertures 204. The lower portion 194 of such tie component 188 comprises fastener extension 207, which extends at a right angle from riser 201 and further comprises top plate flaps 208, 209. A plural ity of apertures 204 for inserting fasteners, such as nails are disposed on such fastener extension 207, and top plate flaps 208, 209. Such upper portion 196 of such cradle component 189 comprises a wall 212 having a plurality of apertures 204. The lower portion 198 of such cradle component 189 comprises fastener extension 214, which extends at a right angle from wall 212 and further comprise top plate flaps 215, 216 and cradle wall 219. A plurality of apertures 204 for inserting fasteners, such as nails, are disposed on such fastener extension 214, top plate flaps 215, 216, and cradle wall 219. Such plurality of apertures should be disposed in a staggered fashion to prevent splitting of the top plate and rafters when inserting such fasteners.

Cradle wall 219 is disposed on an outward edge of fastener extension 214 and extends upward, substantially perpendicular to such fastener extension 214. In general, cradle wall 219 is preferably shorter than and substantially parallel to wall 212.

Figure 8:
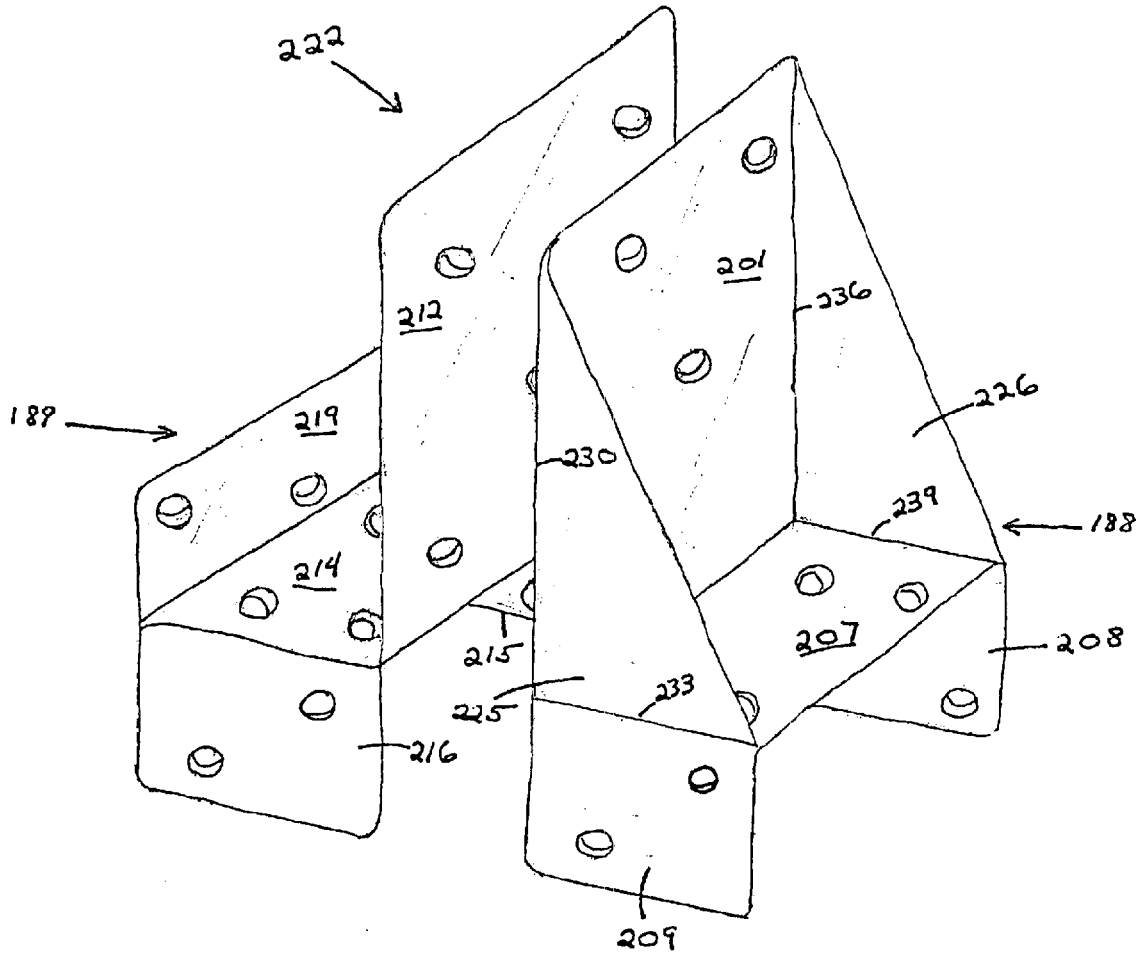
FIG. 8 shows and illustration of a joist cradle tie in perspective according to an alternate embodiment of the present invention.

FIG. 8 illustrates an alternate embodiment of a joist cradle tie, indicated generally as 222, according to the present invention. For heavy-duty applications, joist cradle tie 222 further comprises reinforcing wings 225, 226. Such reinforcing wings 225, 226 are generally triangular in shape. For example, reinforcing wing 225 extends from the forward edge 230 of riser 201 to the end of forward edge 233 of fastener extension 207 and reinforcing wing 226 extends from the rear edge 236 of riser 201 to the end of rear edge 239 of fastener extension 207. Such reinforced joist cradle tie 222 provides vertical reinforcement to prevent balking while enabling increased rigidity to such joist cradle tie 222, resulting in a sturdier, stronger roof tie. Such increased strength can be obtained at reduced cost by enabling use of lower galvanized steel gauges for its construction.

Figure 9A:
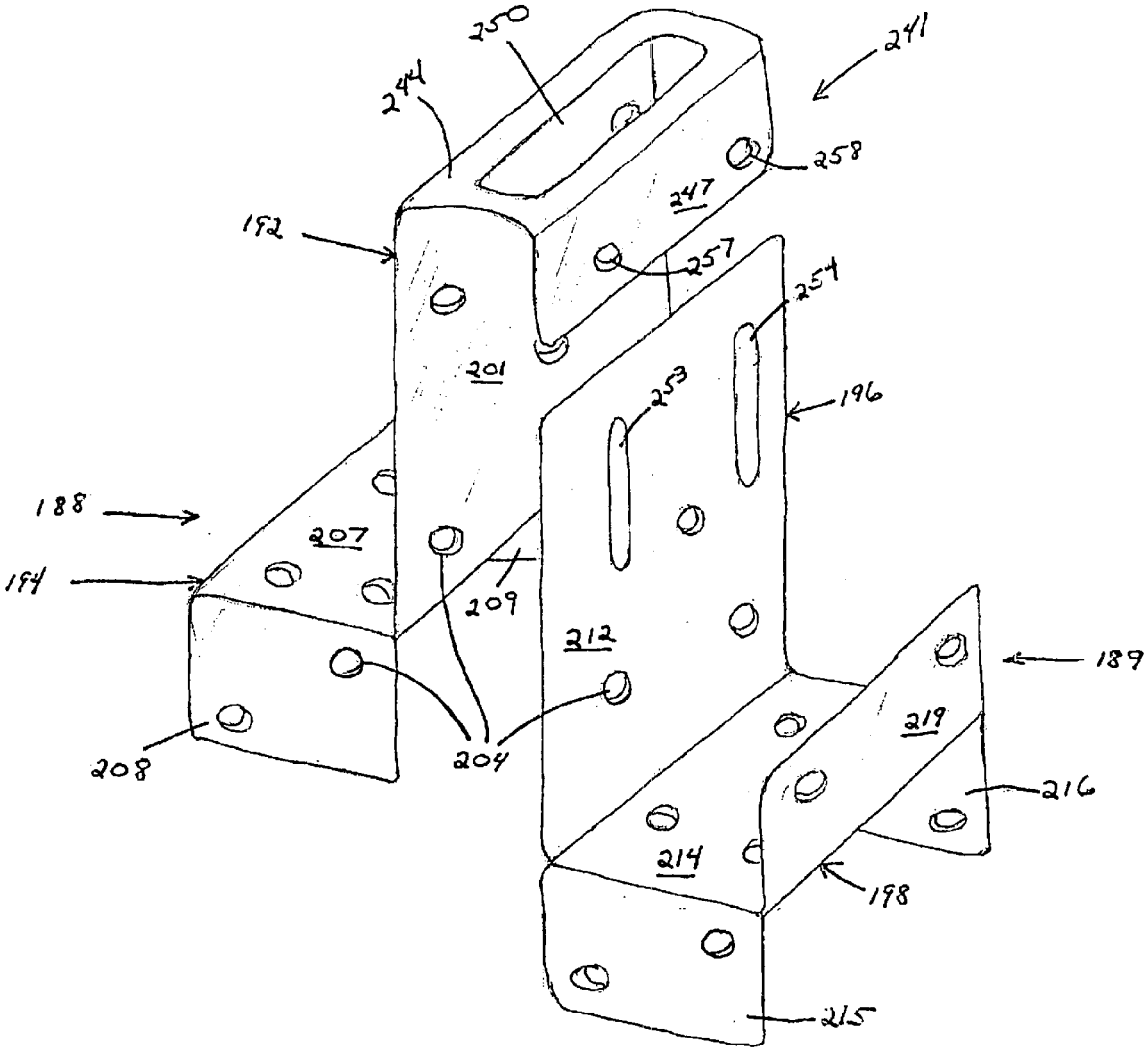
FIG. 9*a* shows an illustration of a roof tie in perspective according to an alternate embodiment of the present invention.
Figure 9B:
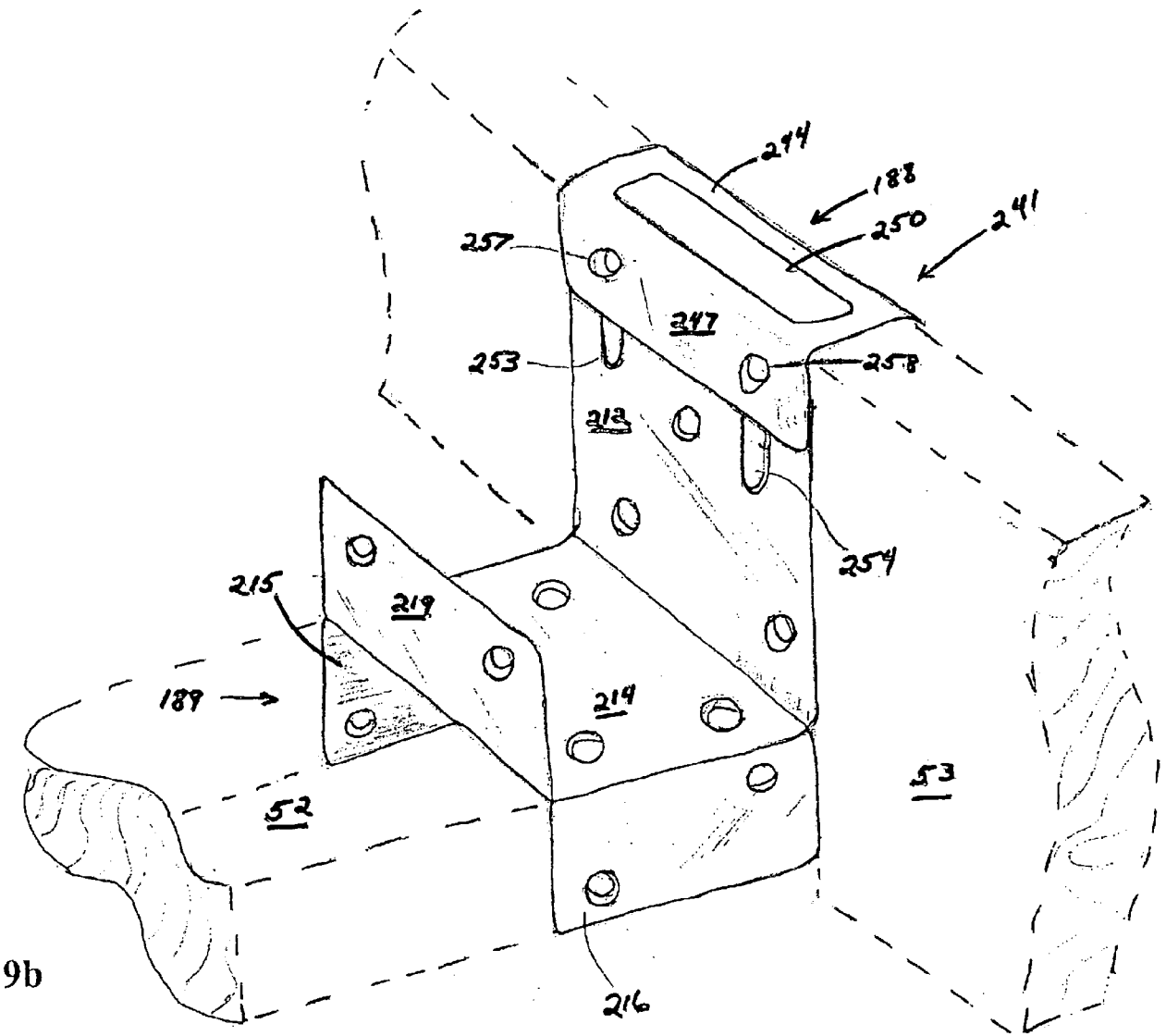
FIG. 9*b* shows an illustration of the roof tie of FIG. 9*a*, with top plate and rafter in phantom.

FIGS. 9*a* and 9*b* illustrate an alternate embodiment of a joist cradle tie, indicated generally as 241, according to the present invention. Joist cradle tie 241 comprises a tie component 188 and a cradle component 189, such tie component 188 having an upper portion 192 and a lower portion 194 and such cradle component 189 having an upper portion 196 and a lower portion 198. Such upper portion 192 of such tic component 188 comprises a riser 201 having a bridge 244 connecting to a short riser 247, substantially parallel to riser 201. The lower portion 194 of such tie component 188 comprises fastener extension 207, which further comprise top plate flaps 208, 209. A plurality of apertures 204 for inserting fasteners, such as nails are disposed on such riser 201, short riser 247, fastener extension 207 and top plate flaps 208, 209. Bridge 244 presents a large window area 250 to permit fastening decking to a rafter.

Such upper portion 196 of such cradle component 189 comprises a wall 212 having a plurality of apertures 204 and slots 253, 254. In use, short riser 247 overlaps wall 212. Such slots 253, 254 are disposed such that, in use, fasteners inserted in apertures 257, 258 in short riser 247 can penetrate such slots 253, 254, respectively. The lower portion 198 of such cradle component 189 comprises fastener extension 214, which further comprise top plate flaps 215, 216 and cradle wall 219. A plurality of apertures 204 for inserting fasteners, such as nails, are disposed on such fastener extension 214, top plate flaps 215, 216, and cradle wall 219. Such plurality of apertures should be disposed in a staggered fashion to prevent splitting of the top plate and rafters when inserting such fasteners.

Cradle wall 219 is disposed on an outward edge of fastener extension 214 and extends substantially perpendicular to such fastener extension 214. In general, cradle wall 219 is preferably shorter than and substantially parallel to wall 212.

Joist cradle tie 241 can adapt to rafters of varying heights for application in a variety of construction scenarios. Slots 253, 254 enable fasteners to be inserted in such a manner to ensure a snug fit for bridge 255 on the top of rafter 53. Short riser 247 overlaps wall 212 such that fasteners inserted in apertures 257, 258 also enter slots 253, 254 at a variable position depending on the height of rafter 53 for attachment to such rafter 53.

Figure 9C:
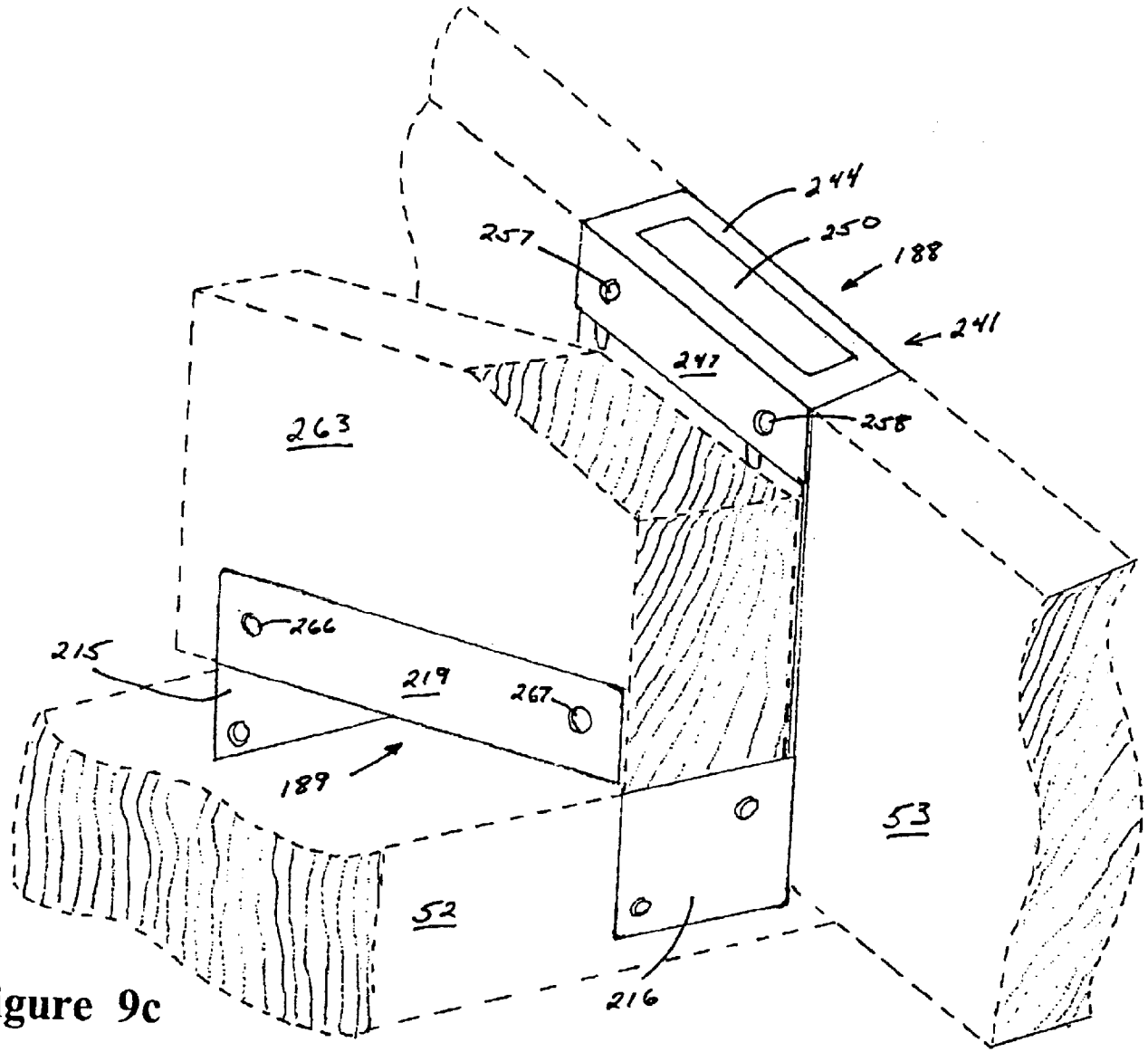
FIG. 9*c* shows an illustration of the roof tie of FIG. 9*a*, in perspective, showing a ceiling joist in place.

As illustrated in FIG. 9*b*, joist cradle tie 241 is presented in a position for fastening to top plate 52 and rafter 53. Fasteners are attached to top plate 52 and rafter 53 through apertures 204 and through apertures 257, 258 in alignment with slots 253, 254, respectively. When joist cradle tie 214 is attached to top plate 52 and rafter 53, a ceiling joist 263 can be set in the cradle component 189 as shown in FIG. 9*c*. Fasteners are attached to ceiling joist 263 through apertures 266, 267 in cradle wall 219. Using a fastener in each opening ensures a strong and secure attachment. Additional embodiments using various numbers of holes can be used based on specific engineering requirements as determined by one skilled in the art.

It will be appreciated by persons skilled in the art that numerous variations and/or modifications may be made to the invention as shown in the specific embodiments without departing from the spirit or scope of the invention as broadly described. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention may be practiced otherwise than as specifically set forth herein. The present embodiments are, therefore, to be considered in all respects as illustrative and not restrictive.

While specific values, relationships, materials and steps have been set forth for purposes of describing concepts of the invention, it should be recognized that, in the light of the above teachings, those skilled in the art can modify those specifics without departing from basic concepts and operating principles of the invention taught herein.

What is claimed is:

1. A roof tie for connecting wood members in building structures, comprising:

a. a first connector adapted for attaching such roof tie to a first roofing member, comprising:

(1) a first substantially horizontal fastener extension having a forward edge, a rear edge, an inside edge, and an outside edge; and (2) a pair of flaps extending downwardly at right angles from the forward edge and the rear edge of such first fastener extension; and b. a second connector adapted for attaching such roof tie to a second roofing member, comprising:

(1) a first riser extending substantially vertical at a right angle from the inside edge of such first fastener extension;

(2) a second riser substantially parallel to such first riser; and (3) a bridge connecting the top of such first and second riser, such bridge further comprising a large window area of sufficient size for attaching roof sheathing to said second roofing member through said window area while said roof sheathing covers said roof tie.

2. The roof tie according to claim 1, wherein:

a. such bridge provides separation between such first riser and such second riser corresponding to the thickness of standard building materials used for such second roofing member.

3. The roof tie according to claim 1, wherein:

a. such second riser is longer than such first riser.

4. The roof tie according to claim 1, such first riser having a forward edge and a rear edge, such roof tie further comprising:

a. a first wing member extending from the forward edge of such first riser and connected to such first fastener extension along the forward edge of such first fastener extension; and b. a second wing member extending from the rear edge of such first riser and connected to such first fastener extension along the rear edge of such first fastener extension.

5. The roof tie according to claim 1, further comprising:

a. such first riser having a forward edge and a rear edge, wherein the forward edge is longer than the rear edge;

b. such second riser having a forward edge and a rear edge, wherein the forward edge is longer than the rear edge, wherein c. such bridge is angled corresponding to a predetermined roof pitch.

6. The roof tie according to claim 1, further comprising:

a. a third connector adapted for attaching such roof tie to such first roofing member, comprising:

(1) a second substantially horizontal fastener extension having a forward edge, a rear edge, an inside edge, and an outside edge;

(2) a pair of flaps extending downwardly at right angles from the forward edge and the rear edge of such second fastener extension; and (3) such second riser extending substantially vertical at a right angle to the inside edge of such second fastener extension.

7. The roof tie according to claim 6, such first riser having a forward edge and a rear edge, and such second riser having a forward edge and a rear edge, such roof tie further comprising:

a. a first wing member extending from the forward edge of such first riser and connected to such first fastener extension along the forward edge of such first fastener extension;

b. a second wing member extending from the rear edge of such first riser and connected to such first fastener extension along the rear edge of such first fastener extension;

c. a third wing member extending from the forward edge of such second riser and connected to such second fastener extension along the forward edge of such second fastener extension; and d. a fourth wing member extending from the rear edge of such second riser and connected to such second fastener extension along the rear edge of such second fastener extension.

8. The roof tie according to claim 6, wherein such third connector further comprises:

a. a cradle wall extending upwardly at a right angle from the outside edge of such second fastener extension.

9. The roof tie according to claim 8, wherein:

a. such cradle wall is shorter than such second riser.

10. The roof tie according to claim 8, such first riser having a forward edge and a rear edge, such roof tie further comprising:

a. a first wing member extending from the forward edge of such first riser and connected to such first fastener extension along the forward edge of such first fastener extension; and b. a second wing member extending from the rear edge of such first riser and connected to such first fastener extension along the rear edge of such first fastener extension.

11. A roof tie for connecting wood members in building structures, comprising:

a. a first connector adapted for attaching such roof tie to a first roofing member, comprising:

(1) a first substantially horizontal member having a forward edge, a rear edge, an inside edge, and an outside edge; and (2) a pair of flaps extending downwardly at right angles from such forward edge and such rear edge of such first horizontal member;

b. a second connector adapted for attaching such roof tie to a second roofing member, comprising:

(1) a first riser extending substantially vertical at a right angle from such inside edge of such first horizontal member;

(2) a second riser substantially parallel to such first riser, wherein such second riser is shorter than such first riser, and (3) a bridge connecting the top of such first and second riser; and c. a third connector adapted for attaching such roof tie to such first roofing member, comprising:

(1) a second substantially horizontal member having a forward edge, a rear edge, an inside edge, and an outside edge;

(2) a pair of flaps extending downwardly at right angles from such forward edge and such rear edge of such second horizontal member, and (3) a wall extending substantially vertical at a right angle to such inside edge of such second horizontal member, enabling such second riser to partly overlap such wall; and d. such second riser being pierced by at least one aperture and such wall being pierced by at least one slot for inserting a fastener therethrough, such that such at least one aperture on such second riser can align with such at least one slot on such wall when such second riser overlaps such wall.

12. The roof tie according to claim 11, further comprising:

a. means for attaching roof sheathing to such second roofing member through such bridge.

13. The roof tie according to claim 12, wherein:

a. such means for attaching roof sheathing to such second roofing member through such bridge comprises a window area.

14. The roof tie according to claim 11, wherein:

a. such bridge provides separation between such first riser and such second riser corresponding to the thickness of standard building materials used for such second roofing member.

15. The roof tie according to claim 11, such first riser having a forward edge and a rear edge, such roof tie further comprising:

a. a first wing member extending from such forward edge of such first riser and connected to such first horizontal member along such forward edge of such first horizontal member; and b. a second wing member extending from such rear edge of such first riser and connected to such first horizontal member along such rear edge of such first horizontal member.

16. The roof tie according to claim 11, wherein such third connector further comprises:

a. a cradle wall extending upwardly at a right angle from such outside edge of such second horizontal member.

17. The roof tie according to claim 16, wherein:

a. such cradle wall is shorter than such second riser.

18. A roof tie for connecting wood members in building structures, comprising:

a. a first connector adapted for attaching such roof tie to a first roofing member, comprising:

(1) a first substantially horizontal member having a forward edge, a rear edge, an inside edge, and an outside edge;

(2) a pair of flaps extending downwardly at right angles from such forward edge and such rear edge of such first horizontal member; and (3) a first riser extending substantially vertical at a right angle from such inside edge of such first horizontal member adapted for attaching such first riser to a second roofing member; and b. a second connector adapted for attaching such roof tie to such first roofing member, comprising:

(1) a second substantially horizontal member having a forward edge, a rear edge, an inside edge, and an outside edge;

(2) a pair of flaps extending downwardly at right angles from such forward edge and such rear edge of such second horizontal member;

(3) a second riser extending substantially vertical at a right angle from such inside edge of such second horizontal member adapted for attaching such second riser to such second roofing member; and (4) a cradle wall extending upwardly at a right angle from such outside edge of such second horizontal member.

19. The roof tie according to claim 18, wherein:

a. such cradle wall is shorter than such second riser.

20. The roof tie according to claim 18, such first riser having a forward edge and a rear edge, such roof tie further comprising:

a. a first wing member extending from such forward edge of such first riser and connected to such first horizontal member along such forward edge of such first horizontal member; and b. a second wing member extending from such rear edge of such first riser and connected to such first horizontal member along such rear edge of such first horizontal member.

* * * * *